US009586787B2

(12) United States Patent
Okamoto

(10) Patent No.: US 9,586,787 B2
(45) Date of Patent: Mar. 7, 2017

(54) CORD REEL DEVICE

(71) Applicant: Panasonic Intellectual Property Management Co., Ltd., Osaka-shi, Osaka (JP)

(72) Inventor: Hirotaka Okamoto, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 143 days.

(21) Appl. No.: 14/385,773

(22) PCT Filed: Mar. 8, 2013

(86) PCT No.: PCT/JP2013/001522

§ 371 (c)(1),
(2) Date: Sep. 17, 2014

(87) PCT Pub. No.: WO2013/140736

PCT Pub. Date: Sep. 26, 2013

(65) Prior Publication Data

US 2015/0108265 A1 Apr. 23, 2015

(30) Foreign Application Priority Data

Mar. 23, 2012 (JP) ..... 2012-066599

(51) Int. Cl.
*B65H 75/34* (2006.01)
*B65H 75/44* (2006.01)

(52) U.S. Cl.
CPC ..... *B65H 75/34* (2013.01); *B65H 75/446* (2013.01); *B65H 75/4434* (2013.01);
(Continued)

(58) Field of Classification Search
CPC ..... B65H 75/4431; B65H 2701/33; B65H 75/449; B65H 75/34; B65H 75/4434;
(Continued)

(56) References Cited

U.S. PATENT DOCUMENTS 2,912,140 A * 11/1959 Cole ..... B65C 11/00 221/70
4,384,688 A * 5/1983 Smith ..... B65H 75/4434 191/12.2 R (Continued)

FOREIGN PATENT DOCUMENTS

JP H01-160685 U 11/1989
JP H9-512401 A 12/1997

(Continued)

OTHER PUBLICATIONS

International Search Report from the corresponding International Application No. PCT/JP2013/001522 issued on Apr. 9, 2013.

(Continued)

*Primary Examiner* — William A Rivera
(74) *Attorney, Agent, or Firm* — Shinjyu Global IP

(57) ABSTRACT

The cord reel device comprises a first reel body and a second reel body which are linked so that their rotational axes coincide; a pullout cord that is wound around the first reel body so that it can be pulled out; an internal cord that is wound around the second reel body in the same direction as the winding direction of the pullout cord; and a reel case that rotatably covers the first reel body and the second reel body and forms a winding space that allows free play of the internal cord. A convex portion that protrudes toward the rotational axis is provided to the reel case.

8 Claims, 10 Drawing Sheets

(52) U.S. Cl.
CPC ..... *B65H 75/4452* (2013.01); *B65H 75/4471* (2013.01); *B65H 2701/3919* (2013.01)

(58) Field of Classification Search
CPC ..... B65H 75/4452; B65H 75/4471; B65H 75/446; B65H 2701/3919
USPC .... 242/378, 378.1, 378.2, 385.4; 191/12.2 R
See application file for complete search history.

(56) References Cited

U.S. PATENT DOCUMENTS

| | | | | |
|---|---|---|---|---|
| 4,590,089 | A * | 5/1986 | Cartmell | A61B 5/04026 417/2 |
| 4,824,517 | A * | 4/1989 | Leahy | B65C 11/00 156/759 |
| 5,094,396 | A * | 3/1992 | Burke | B65H 75/44 242/375 |
| 6,019,304 | A * | 2/2000 | Skowronski | B65H 75/4434 242/373 |
| 6,446,898 | B1 * | 9/2002 | Hwang | B65H 75/4449 242/378.1 |
| 6,497,378 | B1 * | 12/2002 | Liao | B65H 75/4449 191/12.2 A |
| 6,616,080 | B1 | 9/2003 | Edwards et al. | |
| 7,216,665 | B1 | 5/2007 | Sims, Jr. | |
| 8,387,763 | B2 * | 3/2013 | Burke | B65H 75/4449 191/12 R |
| 9,221,652 | B2 * | 12/2015 | Skowronski | B65H 75/4449 |
| 2003/0146332 | A1 * | 8/2003 | Vinding | A61M 39/08 242/378.4 |

FOREIGN PATENT DOCUMENTS

| | | | |
|---|---|---|---|
| JP | 2001-089037 | A | 4/2001 |
| JP | 2002-544093 | A | 12/2002 |
| JP | 2009-247598 | A | 10/2009 |
| WO | 95/29552 | A1 | 11/1995 |

OTHER PUBLICATIONS

Office Action from the corresponding Japanese Patent Application No. 2014-505999 issued on Mar. 1, 2016.

* cited by examiner

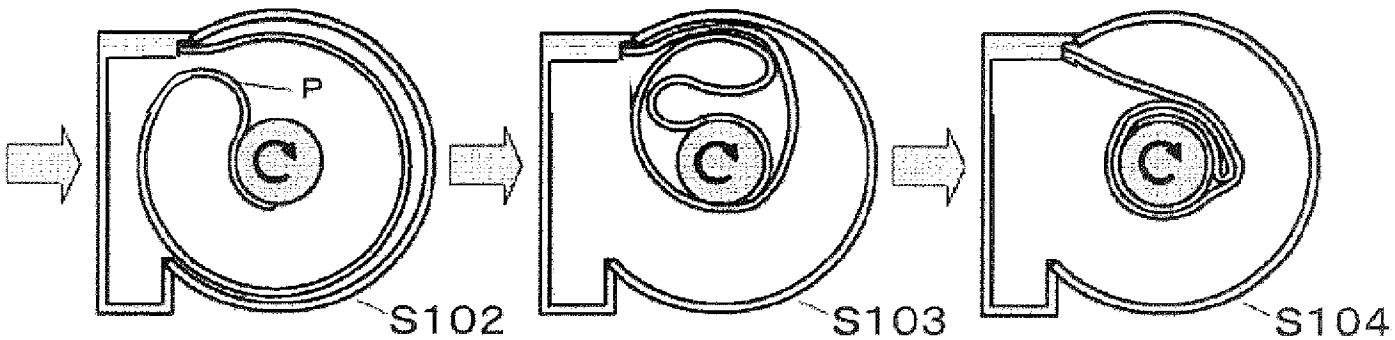
FIG. 10A
FIG. 10B
FIG. 10C
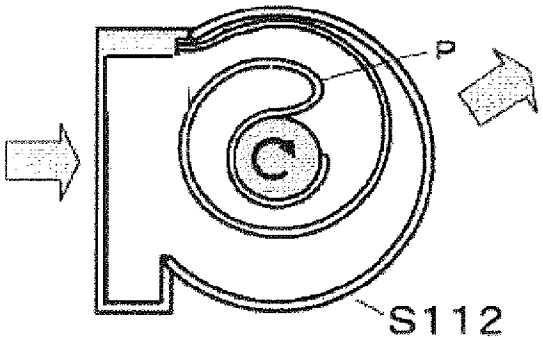
FIG. 10D

CORD REEL DEVICE

PRIORITY

This application claims priority to International Application PCT/JP2013/001522, with an international filing date of Mar. 8, 2013, which claims priority to Japanese Patent Application No. JP 2012-066599 filed on Mar. 23, 2012. The entire disclosures of International Application PCT/JP2013/001522 and Japanese Patent Application No. JP 2012-066599 are hereby incorporated herein by reference.

TECHNICAL FIELD

The present invention relates to a cord reel device that is used for various kinds of cord, such as in a handset or an operation terminal device.

BACKGROUND

In an airplane or other such vehicle for transporting passengers, onboard service systems that offer various kinds of service to the passengers are installed.

For example, the seats on an airplane, etc., may be provided with handsets, operation terminal devices, headphone devices, AV viewing systems, or the like. This offers passengers a wide range of services, such as telephone, movies, games, and connection to the Internet.

These handsets, operation terminal devices, headphone devices, and so forth are connected by cord to a connector or electronic device provided inside the seat.

For example, on an airplane, a handset may be housed in a cradle provided to the armrest of the seat. When a passenger lifts the handset from the cradle, a cord is pulled out from a cord reel device provided on the back of the cradle. Since the handset cord is thus connected to the cord reel device, the handset cannot be moved very far from the cradle.

SUMMARY

However, winding can be a problem with conventional cord reel devices, making them less than reliable. Also, if the cord of the handset was a curled cord, for example, the cord may sometimes be stretched too far, allowing the handset to fall on the floor.

It is an object of the present invention to solve the above problems, and to provide a cord reel device with which there will be no winding problems, and which is therefore more reliable.

To achieve the stated object, the cord reel device pertaining to the present invention comprises first and second reel bodies, a reel case, a pullout cord, an internal cord, and a convex portion. The first reel body and second reel body are linked in the rotational axis direction so that their rotational axes coincide. The reel case houses the first reel body and the second reel body in a rotatable state. The pullout cord is wound around the first reel body so that it can be pulled out, and is pulled outside of the reel case. The internal cord is wound around the second reel body in the same direction as the winding direction of the pullout cord, and has free play in a space formed inside the reel case as the pullout cord is pulled out. The convex portion is provided to the reel case and protrudes toward the space in which the internal cord is wound.

Consequently, a very reliable cord reel device can be provided with which no winding problems are encountered.

Also, with the cord reel device disclosed herein, it is preferable if the convex portion protrudes toward the rotational axis in the space in which the internal cord is wound.

Also, with the cord reel device disclosed herein, it is preferable if the convex portion is provided in the space formed in the reel case and in which the internal cord is wound, upstream from the position where a second end is fixed on the opposite side from a first end connected to the rotational axis of the internal cord, in the winding direction of the internal cord when the pulled-out pullout cord is wound.

Also, with the cord reel device disclosed herein, it is preferable if the convex portion is formed integrally with the reel case.

Also, it is preferable if the cord reel device disclosed herein further comprises side wall portions that are provided to the pullout cord winding shaft of the second reel body, and are provided so as to incline at a specific angle with respect to the winding direction of the pullout cord.

Also, with the cord reel device disclosed herein, it is preferable if the convex portion has a substantially arc-shaped cord latching wall as part of the wall face forming the protruding portion.

Also, with the cord reel device disclosed herein, it is preferable if, in the winding of the pulled-out pullout cord, the cord latching wall is disposed on an upstream face in the winding direction of the internal cord.

Also, the cord reel device disclosed herein comprises first and second reel bodies, a reel case, a pullout cord, an internal cord, and side wall portions. The first reel body and the second reel body are linked in the rotational axis direction so that their rotational axes coincide. The reel case houses the first reel body and the second reel body in a rotatable state. The pullout cord is wound around the first reel body so that it can be pulled out, and is pulled outside of the reel case. The internal cord is wound around the second reel body in the same direction as the winding direction of the pullout cord, and has free play in a space formed inside the reel case as the pullout cord is pulled out. The side wall portions are provided to the pullout cord winding shaft of the second reel body, and are provided so as to incline at a specific angle with respect to the winding direction of the pullout cord.

Consequently, a very reliable cord reel device can be provided with which no winding problems are encountered.

It is also preferable if the specific angle of the cord reel device disclosed herein is at least 3 degrees and no more than 10 degrees.

Advantageous Effects

The present invention provides a very reliable cord reel device with which winding problems can be effectively minimized.

BRIEF DESCRIPTION OF DRAWINGS

FIGS. 10A to 10D are cross sections illustrating another wind-up operation with a conventional cord reel device.

DETAILED DESCRIPTION OF EMBODIMENTS

The cord reel device pertaining to an embodiment of the present invention will now be described through reference to the drawings, using a cord reel device connected to a handset as an example. It will be apparent to those skilled in the art from this disclosure that the following descriptions of the embodiments are provided for illustration only and not for the purpose of limiting the invention as defined by the appended claims and their equivalents.

Figure 1:
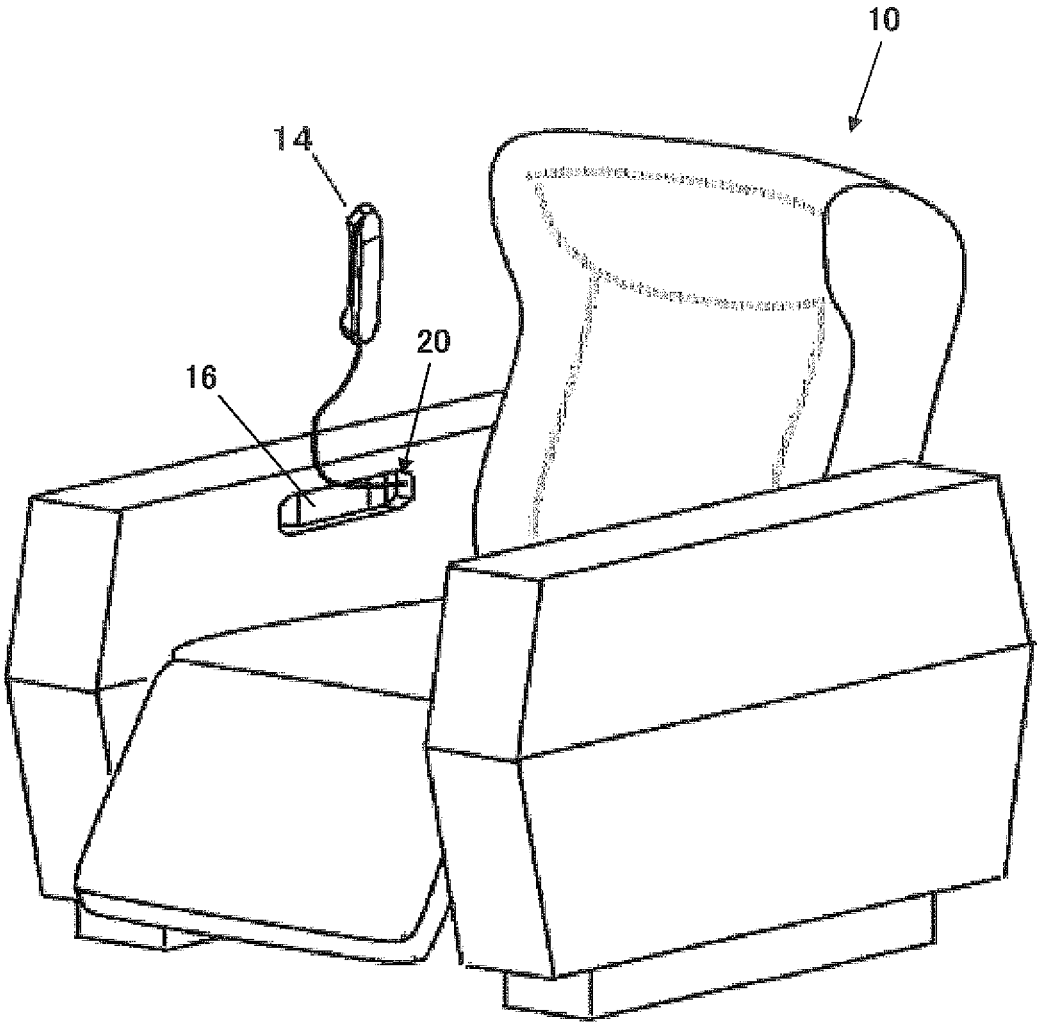
FIG. 1 is an oblique view of an example of an airplane seat in which the cord reel device pertaining to an embodiment of the present invention has been installed.

FIG. 1 is an oblique view of an example of an airplane seat 10 in which the cord reel device disclosed herein has been installed.

A liquid crystal monitor or the like for providing a passenger with movies, games, music, and various other kinds entertainment is installed on the back of the seat 10. As shown in FIG. 1, a handset 14 for operating the liquid crystal monitor, etc., is mounted flush on the armrest of the seat.

Figure 2:
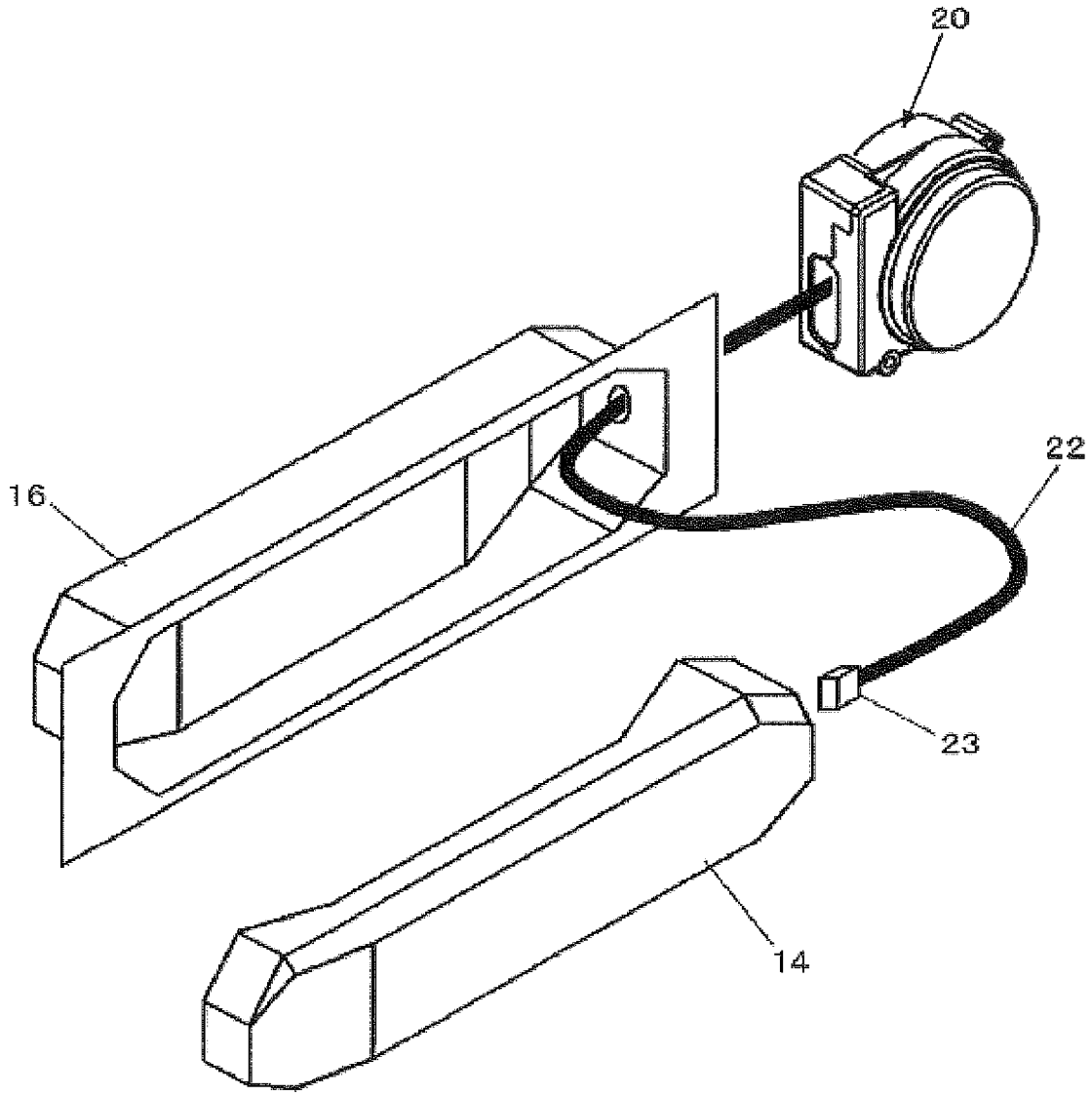
FIG. 2 is an oblique view of an example of the cord reel device installed in the seat in FIG. 1, and a handset connected to this device.

FIG. 2 is an oblique view of an example of the cord reel device 20 of this embodiment, and the handset 14 connected to this device.

As shown in FIG. 2, the handset 14 is housed in a cradle 16. The cord reel device 20 is installed on the back of the cradle 16. A plug 23 that is attached to the end of a pullout cord 22 of the cord reel device 20 is connected to the handset 14.

Cord Reel Device 20

Figure 3:
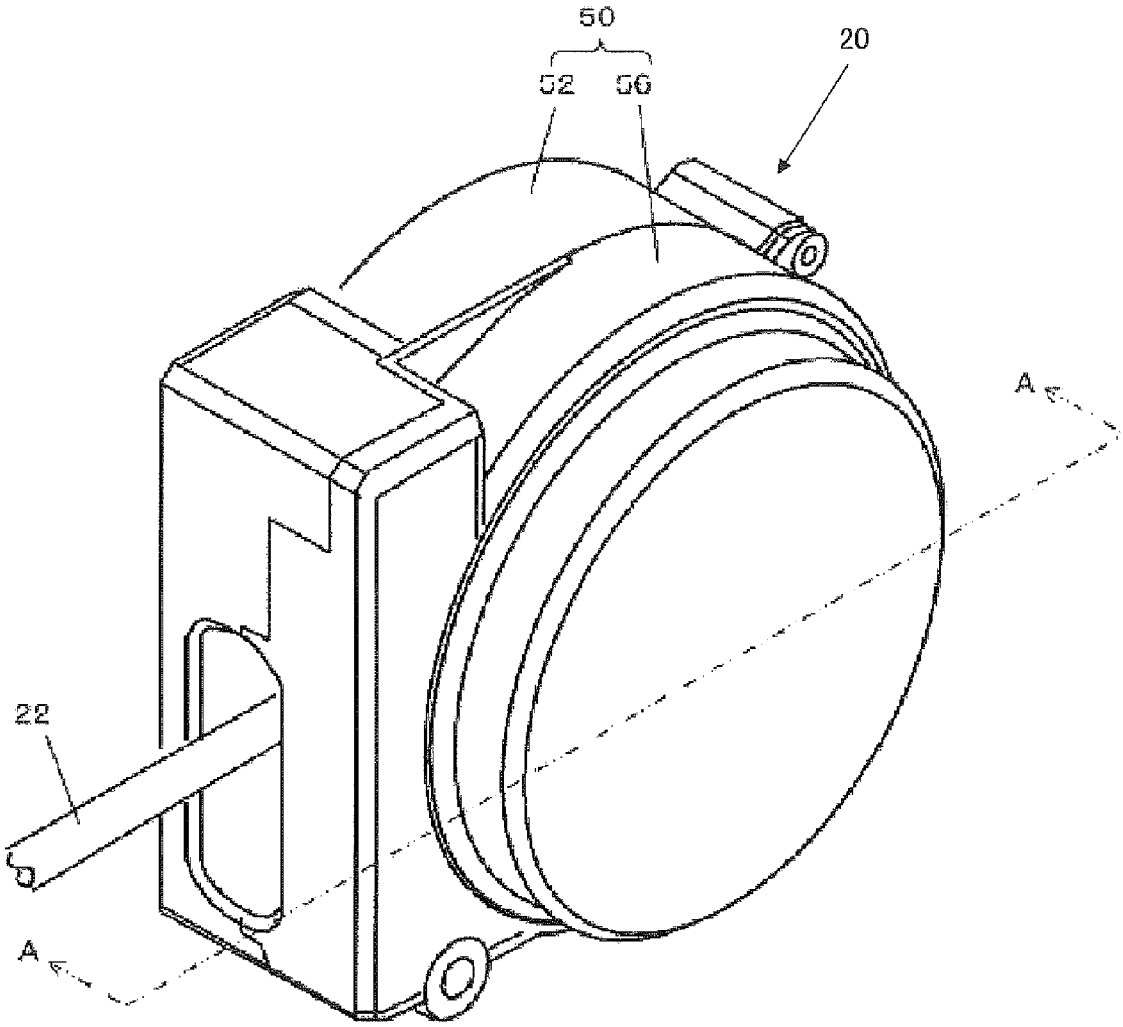
FIG. 3 is an oblique view of the cord reel device in FIG. 2.
Figure 4:
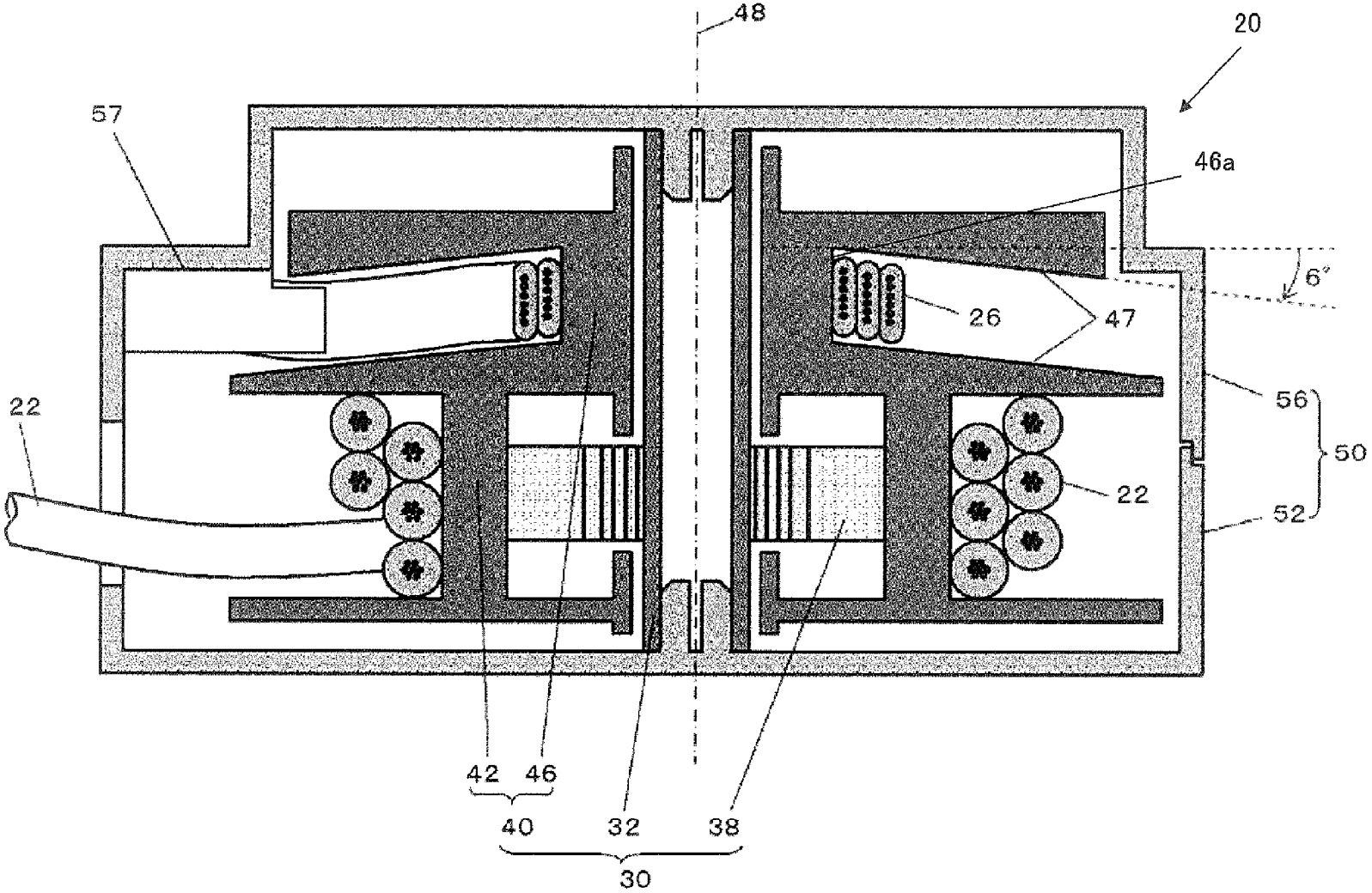
FIG. 4 is a cross section along the A-A line of the cord reel device in FIG. 3.

FIG. 3 is an oblique view of the cord reel device 20 pertaining to this embodiment. FIG. 4 is a cross section along the A-A line in FIG. 3.

As shown in FIGS. 3 and 4, the cord reel device 20 comprises the pullout cord 22, an internal cord 26, a cord reel 30, a reel case 50, and a stopper mechanism (not shown).

The cord reel 30 has a stationary shaft 32, a spiral spring 38, and a reel body 40.

The spiral spring 38 connects the stationary shaft 32 and the reel body 40, and generates a restorative force that winds up the pullout cord 22 that has been pulled out.

As shown in FIG. 4, the reel body 40 has a first reel body 42 and a second reel body 46 that are disposed coaxially. The first and second reel bodies 42 and 46 are formed as integral plastic moldings, and are supported in a rotatable state on the stationary shaft 32.

As shown in FIG. 4, the pullout cord 22 is wound around the first reel body 42. As shown in FIG. 4, the internal cord 26 is wound around the second reel body 46. The first reel body 42 and the second reel body 46 are linked in a rotational axis 48 direction so that their rotational axes 48 will coincide.

Consequently, with the cord reel device 20 in this embodiment, the first reel body 42 and the second reel body 46 are linked in parallel in the extension direction of the stationary shaft 32.

Side walls 47 that face outward radially from the winding face 46*a* on which the internal cord 26 is wound are provided to the second reel body 46. In this embodiment, these side walls 47 are inclined at a specific angle to the winding direction of the internal cord 26 (the vertical direction of the rotational axis 48), as shown in FIG. 4.

The specific angle indicating the inclination angle of the side walls 47 is preferably at least 3 degrees and no more than 10 degrees. In this embodiment, the inclination angle of the side walls 47 is set to 6 degrees.

Figure 5:
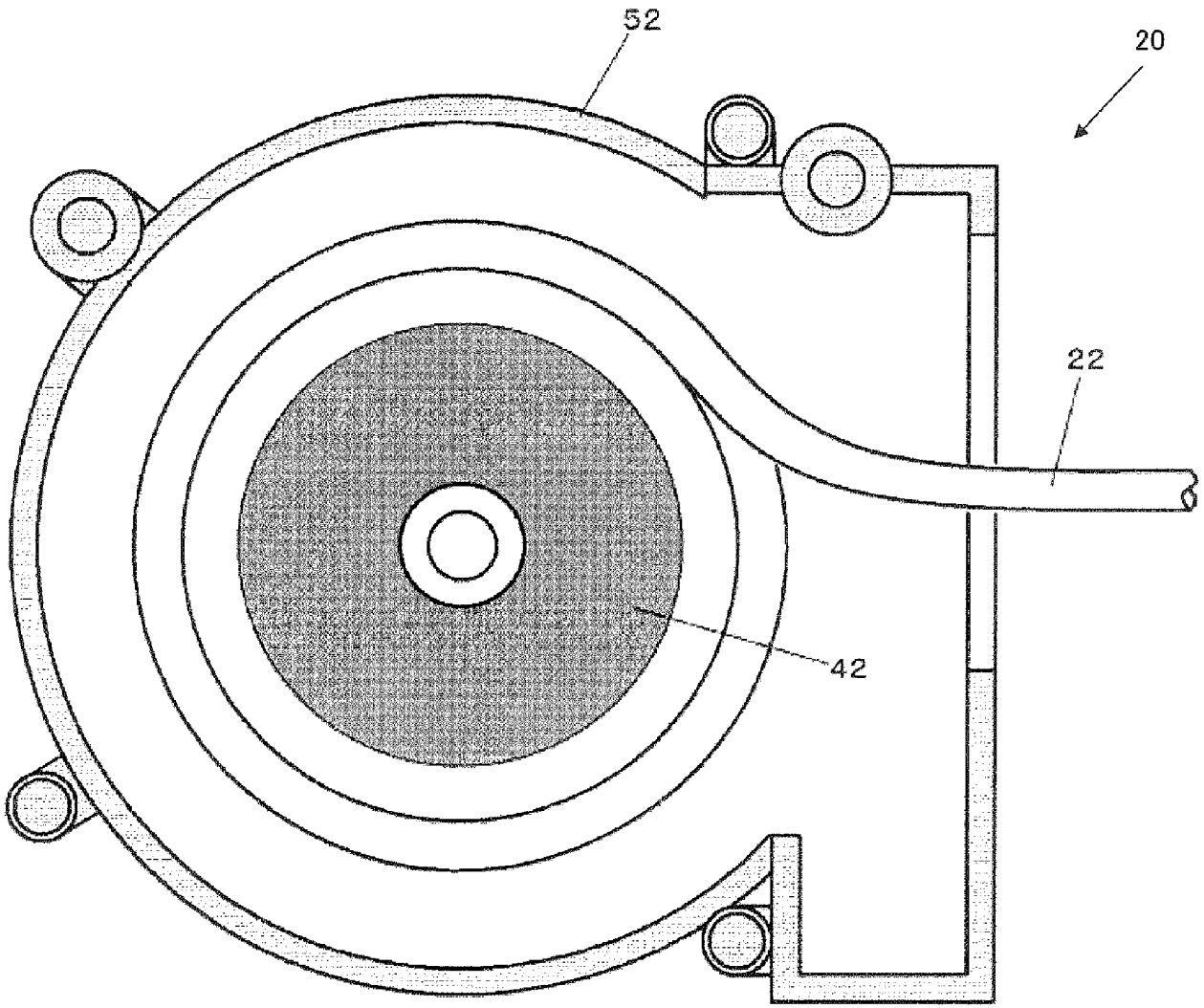
FIG. 5 is a cross section of a pullout cord wound around a first reel body of the cord reel device in FIG. 2.
Figure 6:
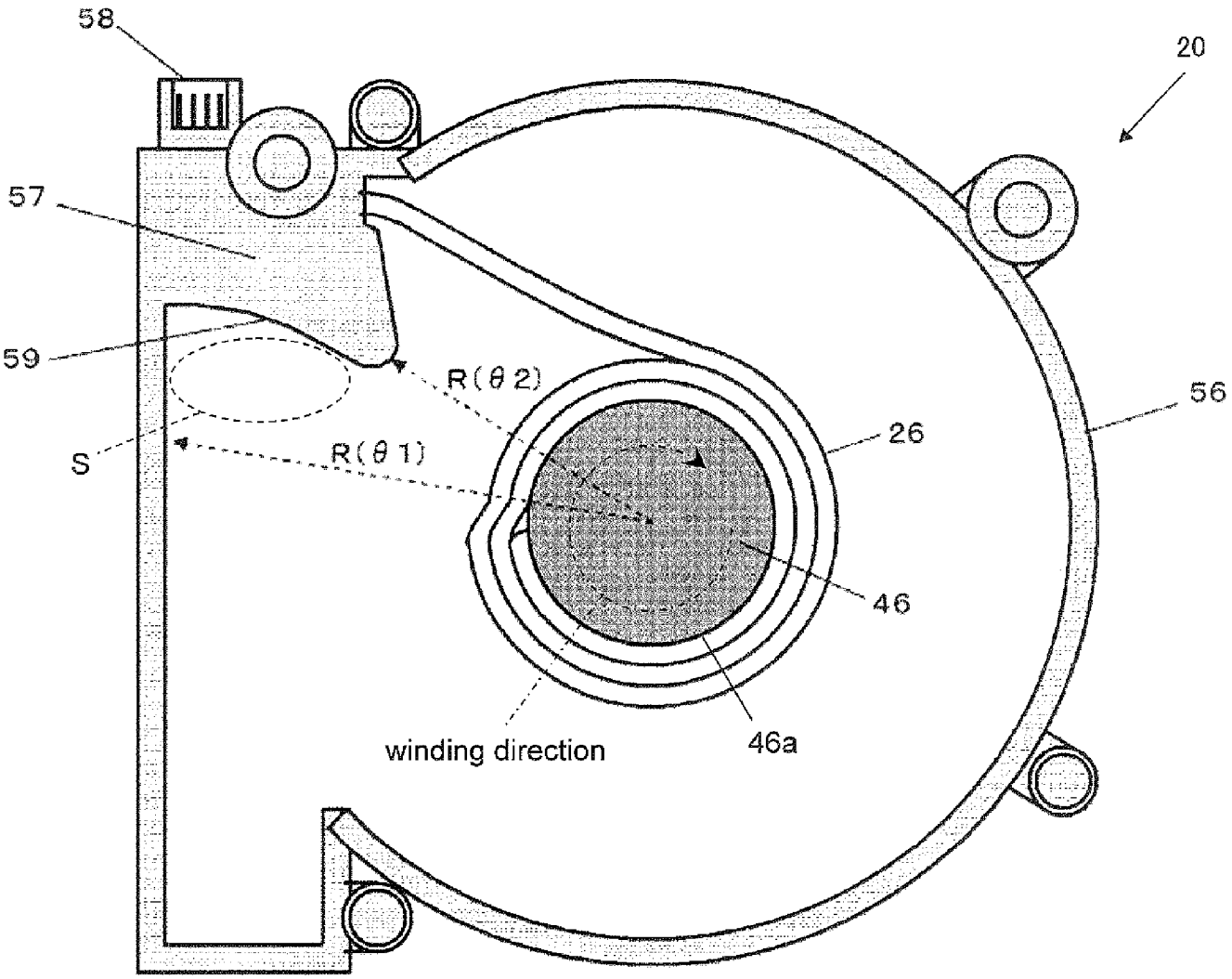
FIG. 6 is a cross section of an internal cord wound around a second reel body of the cord reel device in FIG. 2.

FIG. 5 is a cross section of the pullout cord 22 wound around the first reel body 42 of the cord reel device 20, as seen from the first reel body 42 side. FIG. 6 is a cross section of the internal cord 26 wound around the second reel body 46 of the cord reel device 20, as seen from the second reel body 46 side.

The pullout cord 22 is a cord that can be pulled out from the cord reel device 20 and connected to the handset 14. The pullout cord 22 is pulled into the space on the passenger side and touches the passenger's hands. Therefore, in this embodiment, a relatively strong, round cord with a circular cross sectional shape is used as the pullout cord 22.

The plug 23 (see FIG. 2) that is used to connect to the handset 14 is attached to a first end of the pullout cord 22. The second end of the pullout cord 22 (hereinafter referred to as the "proximal end of the pullout cord 22"), which is on the opposite side from the first end, is fixed to the first reel body 42 as shown in FIGS. 4 and 5.

The pullout cord 22 is wound around the first reel body 42 in a state that allows it to be pulled out, and can be pulled out from the reel case 50 against the restorative force of the spiral spring 38 shown in FIG. 4. Also, when the pullout cord 22 is pulled out to the desired length, it is held there by a stopper mechanism (not shown). Furthermore, when the pullout cord 22 that is being held in its pulled-out state is lightly tugged, the stopper mechanism is released, and the pullout cord 22 is rewound onto the first reel body 42 by the restorative force of the spiral spring 38.

The internal cord 26 is a flat cord with a thin cross sectional shape, and is about half the length of the pullout cord 22. As shown in FIG. 6, the first end of the internal cord 26 is connected to a connector 58 fixed to the reel case 50, at a position on the inner wall side of a second case 56 (the upper-left portion in the drawing). Meanwhile, the second end of the internal cord 26 (hereinafter referred to as the "proximal end of the internal cord 26"), which is on the opposite side from the first end, is connected to the second reel body 46.

The internal cord 26 is wound around the second reel body 46 in the same direction as the winding direction of the pullout cord 22.

The reel case 50 is a plastic case, and has a first case 52 that covers the first reel body 42 side, and the second case 56 that covers the second reel body 46 side. When the first case 52 and the second case 56 have been attached to the stationary shaft 32, the mating of the first case 52 and the second case 56 causes the reel case 50 to envelop the reel body 40 in a rotatable state.

Consequently, the reel case 50 envelops the first reel body 42 and the second reel body 46 in a rotatable state, and forms an internal winding space that allows the free play of the internal cord 26 that occurs during winding of the pullout cord 22.

A convex portion 57 that protrudes into the winding space inside the reel case 50 is formed on the second case 56.

The convex portion 57 is formed integrally with the second case 56 from plastic, as part of the second case 56 (the reel case 50). Also, the convex portion 57 is provided so as to protrude toward the rotational axis of the first and second reel bodies 42 and 46.

As shown in FIG. 6, the convex portion 57 is provided in the space formed in the second case 56 (the reel case 50) and in which the internal cord is wound, upstream from the position where the first end of the internal cord 26 is fixed, in the winding direction of the internal cord 26 (clockwise in the drawing).

The winding direction of the internal cord 26 in this case refers to the direction in which the internal cord 26 is wound (see the dotted line in FIG. 6) when the pullout cord 22 that has been pulled out to the outside is wound onto the first reel body 42.

More specifically, the convex portion 57 is provided at a specific location in order to keep the pullout cord 22 toward the inside of the winding space (the rotational axis side of the second reel body 46) so that the slack portion of the internal cord 26 will not be too large when the pullout cord 22 is moved in and out.

In this embodiment, the convex portion 57 is provided at a location where the internal cord 26 tends to go slack in the operation of the cord reel device 20 (discussed below), that is, at a location upstream in the winding direction from the position where the first end of the internal cord 26 is fixed. This serves as the specific location where the convex portion 57 is provided.

The action and effect of the present invention resulting from the provision of the convex portion 57 will be discussed in detail at a later point.

A cord latching wall 59 that forms a pocket space S (see FIG. 6) for latching the slack portion of the internal cord 26 is provided to part of the side wall forming the convex portion 57.

The cord latching wall 59 is a part of the side wall constituting the above-mentioned convex portion 57, and as shown in FIG. 6, it is formed substantially in an arc shape in side view. Also, the cord latching wall 59 is provided in a shape such that the radius vector R(θ) from the rotational axis of the second reel body 46 to the boundary of the winding space is reduced non-continuously in the deflection angle direction θ.

In particular, as shown in FIG. 6, the cord latching wall 59 is formed so that the radius vector R(θ) to the boundary of the winding space of the internal cord 26 is reduced non-continuously from R(θ1) to R(θ2) in the range from the deflection angle θ1 to the deflection angle θ2 in the direction in which the second reel body 46 rotates during the winding of the pullout cord 22.

Providing the cord latching wall 59 forms the pocket space S (see FIG. 6), which is used to hold the folded-back portion of the slack internal cord 26, at an upstream portion in the winding direction of the convex portion 57.

The detailed action and effect produced by providing the cord latching wall 59 to the cord reel device 20 in this embodiment will be discussed at a later point.

Operation of Cord Reel Device 20

Next, the operation of the cord reel device 20 will be described through reference to FIGS. 7A to 9D.

When the pullout cord 22 is pulled to the desired length by a passenger, it is pulled from the cord reel device 20 against the restorative force of the spiral spring 38.

FIGS. 7A to 7F are cross sections illustrating the pull-out operation with the cord reel device 20 in this embodiment, when the internal cord 26 is seen from the second reel body 46 side.

Figure 7A:
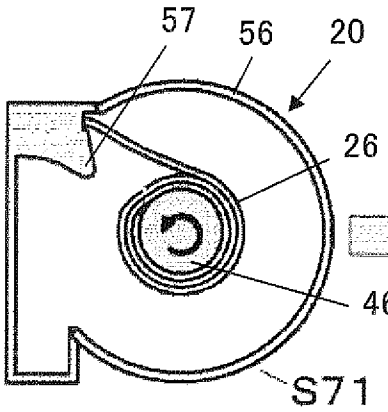
FIGS. 7A to 7F are cross sections illustrating the pull-out operation with the cord reel device in FIG. 2.

FIG. 7A shows a state S71 of the internal cord 26 before the pullout cord 22 is pulled out. When the pullout cord 22 begins to be pulled out from this state S71 against the restorative force of the spiral spring 38, the internal cord 26 begins to come loose, starting from the side connected to the connector 58.

Figure 7B:
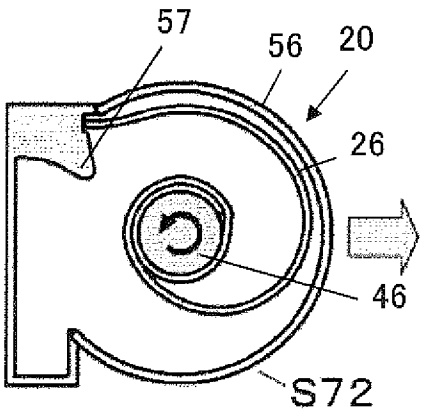

As shown in FIG. 7B, the loose portion of the internal cord 26 here spreads out to near the inner wall face of the second case 56 in the winding space of the internal cord 26 (state S72).

Figure 7C:
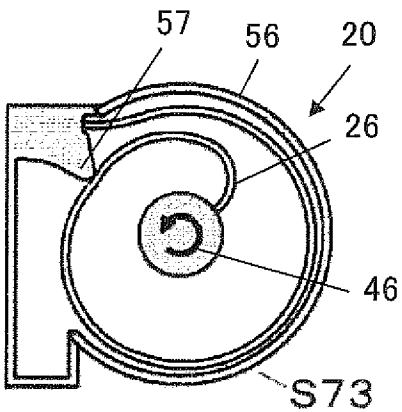

As shown in FIG. 7C, when the pullout cord 22 is then pulled out to about half its length, the entire internal cord 26 comes loose and separates from the second reel body 46, and the internal cord 26 spreads out throughout the entire winding space (state S73).

Figure 7D:
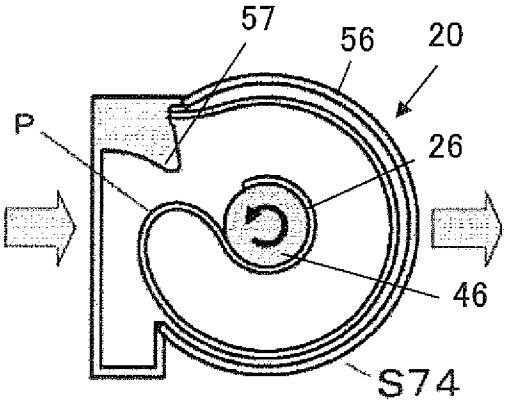

When the pullout cord 22 is then pulled out further, as shown in FIG. 7D, the internal cord 26 begins to be wound onto the second reel body 46 starting from the proximal end (second end) side. At this point, the direction in which the internal cord 26 is wound is the opposite of that in the state S71. A turnaround point P is produced between the loose portion and the wound portion of the internal cord 26 (state S74).

Figure 7E:
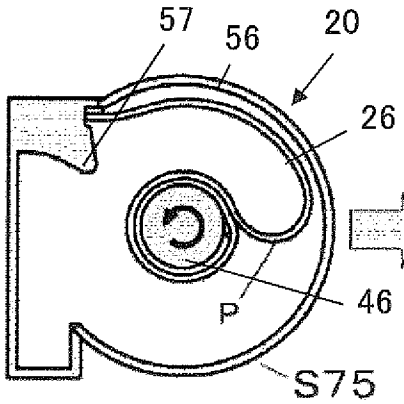

As shown in FIG. 7E, the turnaround pointPmoves in the same direction as the direction in which the second reel body 46 rotates (state S75).

Figure 7F:
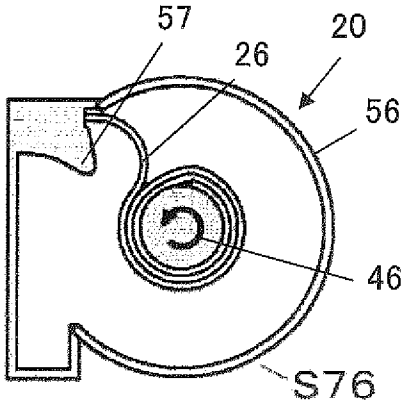

In a state in which the pullout cord 22 has been pulled out, as shown in FIG. 7F, the internal cord 26 is wound onto the second reel body 46 in the opposite direction from that in the state S71 (state S76). When the pulling-out of the pullout cord 22 is then stopped, the stopper mechanism maintains this state S76.

Then, when the pullout cord 22 is to be stowed inside the cord reel device 20, the passenger lightly tugs on the pullout cord 22. This releases the stopper mechanism, and the restorative force of the spiral spring 38 winds the pullout cord 22 into the cord reel device 20 and onto the first reel body 42.

FIGS. 8A to 8F are cross sections of the internal cord 26 as seen from the second reel body 46 side, in order to illustrate the wind-up of the cord reel device 20 in this embodiment.

Figure 8A:
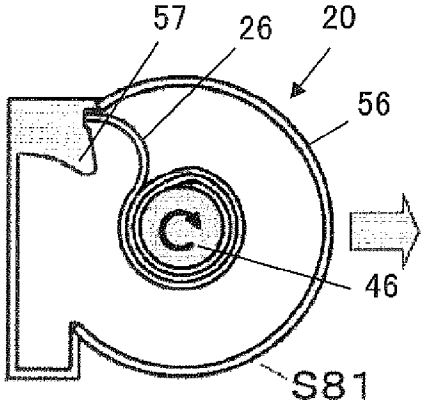
FIGS. 8A to 8F are cross sections illustrating the wind-up operation with the cord reel device in FIG. 2.

As shown in FIG. 8A, in a state in which the pullout cord 22 has been pulled out (state S81), the internal cord 26 is wound in the opposite direction onto the second reel body 46. This state is the same as the state S76 in FIGS. 7A to 7F.

When the pullout cord 22 begins to be wound into the cord reel device 20, the internal cord 26 begins to come loose, starting from the side where the first end is connected to the connector 58.

Figure 8B:
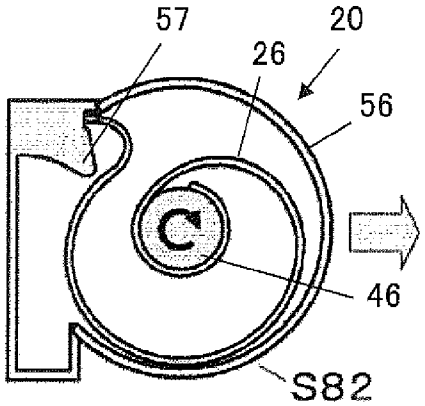

As shown in FIG. 8B, the loose portion of the internal cord 26 spreads out to near the inner wall face of the second case 56 in the winding space of the internal cord 26 (state S82).

Figure 8C:
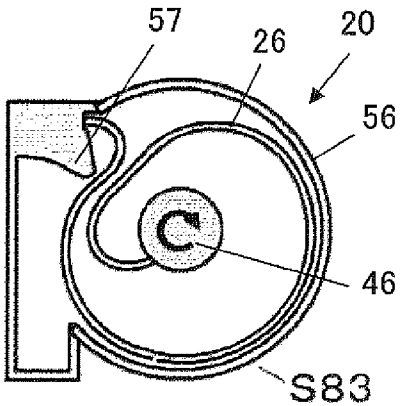

Then, when the pullout cord 22 is wound up to about half its length, as shown in FIG. 8C, the entire internal cord 26 comes loose and separates from the second reel body 46, and spreads out to fill up the winding space of the internal cord 26 (state S83).

When the pullout cord 22 is then wound further, it begins to be wound onto the second reel body 46, starting from the second end (proximal end) side of the internal cord 26. At this point, the winding direction is the opposite of the direction in the state S81.

Figure 8D:
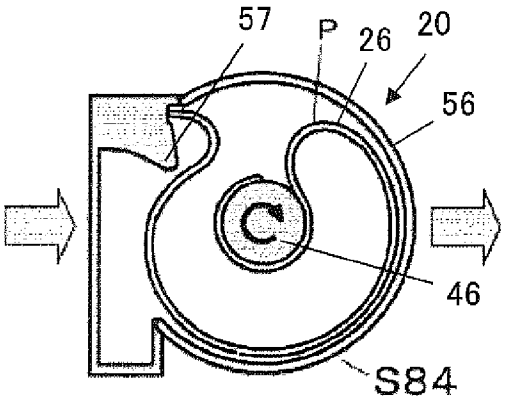
Figure 8E:
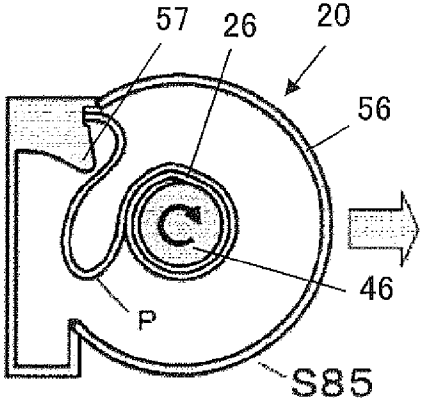

As shown in FIG. 8D, the turnaround point P is then produced between the loose portion and the wound portion of the internal cord 26 (state S84). As shown in FIG. 8E, the turnaround point P moves in the same direction as the direction in which the second reel body 46 rotates (state S85).

Figure 8F:
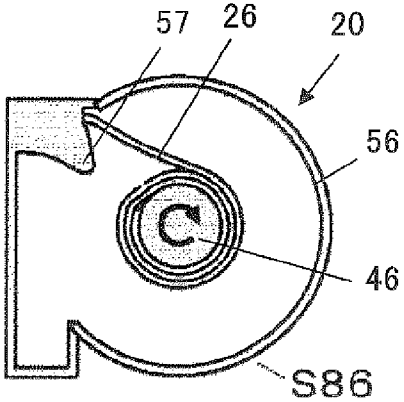

Then, when the pullout cord 22 is completely wound into the cord reel device 20, as shown in FIG. 8F, the internal cord 26 is also wound onto the second reel body 46 (state S86). This state S86 is the same as the state S71 in FIG. 7A.

In the above description, a case was described in which the entire pullout cord 22 was pulled out, but if the pullout cord 22 is pulled out just part of the way, the stopper mechanism will operate at the point when the pulling-out is stopped, and the pullout cord 22 will be held at its length at that point. Also, when the pullout cord 22 is lightly tugged in this state, the restorative force of the spiral spring 38 winds the pullout cord 22 into the cord reel device 20 and onto the first reel body 42.

Here, when the pull-out operation is stopped in a state in which the pullout cord 22 has been pulled out more than half its length, and then the pullout cord 22 is wound into the cord reel device 20, with a conventional cord reel device winding problems are encountered. With the configuration of the cord reel device 20 in this embodiment, however, there is no danger of winding problems in a situation such as this.

FIGS. 9A to 9D are cross sections of the internal cord 26 from the second reel body 46, illustrating another wind-up operation of the cord reel device 20 in this embodiment.

The operation when the pullout cord 22 is wound into the cord reel device 20 from a state S91 in which the pullout cord 22 had been pulled out part-way (the same as the state S74 in FIG. 7D) will now be described in detail.

Figures 9A, 9B, 9C, 9D:
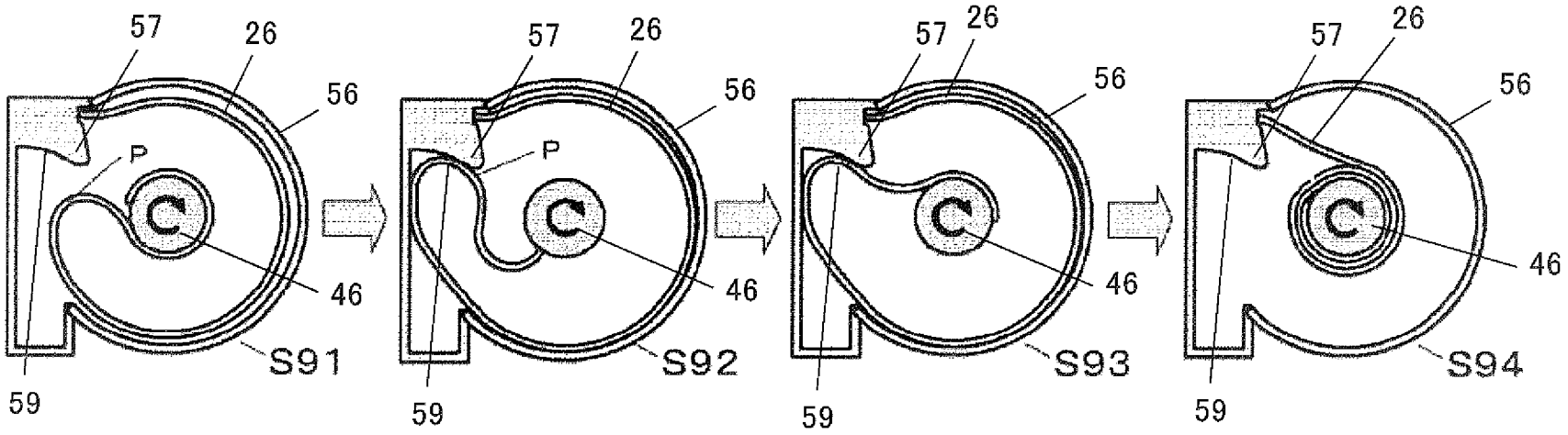
FIGS. 9A to 9D are cross sections illustrating another wind-up operation with the cord reel device in FIG. 2.

First, in the state S91, as shown in FIG. 9A, the winding direction of the internal cord 26 is the opposite of the direction in the state S71. The turnaround point P is produced between the loose portion and the wound portion of the internal cord 26.

In this state, when the pullout cord 22 begins to be wound into the cord reel device 20, this turnaround point P moves in the same direction as the rotation direction of the second reel body 46.

In this embodiment, the convex portion 57 protrudes into the winding space in the second case 56. The convex portion 57 has the substantially arc-shaped cord latching wall 59, such that the radius vector R(θ) from the rotational axis 48 to the boundary of the winding space is reduced non-continuously in the deflection angle direction θ.

Consequently, as shown in FIG. 9B, the turnaround point P of the internal cord 26 will catch on the cord latching wall 59, making it less likely to move beyond the reel case 50 (state S92). Therefore, as shown in FIG. 9C, the turnaround portion is eliminated as the pullout cord 22 is wound further (state S93).

When the pullout cord 22 is then wound completely into cord reel device 20, as shown in FIG. 9D, the internal cord 26 is also wound onto the second reel body 46 (state S94). This state is the same as the state S86, as shown in of FIG. 8A.

Furthermore, in this embodiment, as discussed above and as shown in FIG. 4, the side walls 47 of the second reel body 46 are inclined approximately 6 degrees with respect to the winding direction of the internal cord 26 (the vertical direction of the rotational axis 48).

That is, in this embodiment, the side walls 47 of the internal cord 26 are inclined with respect to the winding direction of the internal cord 26 (the vertical direction of the rotational axis 48). Consequently, in the winding of the internal cord 26, there is more friction between the internal cord 26 and the side walls 47, which prevents the internal cord 26 from being drawn toward the inside of the winding space (the rotational axis direction of the second reel body 46). As a result, this effectively suppresses the winding problems that occur when the turnaround point P of the internal cord 26 moves through the gap between the convex portion 57 and the second reel body 46.

As discussed above, with the cord reel device 20 in this embodiment, the convex portion 57 that protrudes into the winding space is provided in the second case 56. The convex portion 57 has the substantially arc-shaped cord latching wall 59 at which the radius vector R(θ) up to the boundary of the winding space of the internal cord 26 is reduced non-continuously when the deflection angle is changed in the direction in which the pullout cord 22 is wound. Accordingly, the turnaround point P of the internal cord 26 can be effectively prevented from moving beyond the cord latching wall 59.

Furthermore, in this embodiment, the side walls 47 of the second reel body 46 is inclined at a specific angle (approximately 6 degrees in this embodiment) with respect to the vertical line of the rotational axis 48. Accordingly, movement of the turnaround point P through the gap between the convex portion 57 and the second reel body 46 can be effectively suppressed. Therefore, this prevents the turnaround point P from becoming tangled up in the internal cord, so a reliable cord reel device can be provided in which winding problems can be effectively prevented.

Reference Examples

The comparative example shown in FIGS. 10A to 10D will now be described to make the action and effect of the cord reel device 20 in the above embodiment easier to understand.

As shown in FIG. 10A, let us assume that the turnaround point P of the internal cord has moved beyond the position where the cord latching wall 59 in this embodiment is provided (state S102).

As shown in FIG. 10B, the turnaround point P will become tangled up in the internal cord (state S103), and as shown in FIG. 10C, if the internal cord becomes tangled, the second reel body will not be able to rotate (state S104). As a result, the pullout cord cannot be housed inside the cord reel device.

Furthermore, let us assume that the side walls 47 of the second reel body 46 in the above embodiment were perpendicular to the vertical line of the rotational axis 48.

In this case, the portion of the internal cord that had spread into the winding space and is wound to the outside is quickly drawn to the inside of the winding space, and as shown in FIG. 10D, there is the risk that the turnaround point P will move through the gap between the second reel body and the portion where the first end of the internal cord is fixed (state S112).

When the turnaround point P then moves beyond the position of the cord latching wall 59, as shown in FIG. 10B, the turnaround point P becomes tangled up in the internal cord (state S103).

After this, just as discussed above, if the internal cord is tangled, the second reel body will not be able to move, and as shown in FIG. 10C, the pullout cord cannot be housed inside the cord reel device (state S104).

Other Embodiments

A

The specific numerical values used in the above embodiment are nothing but examples, and should be appropriately set to the optimal values as dictated by the cord reel device specifications and so on.

Furthermore, a cord reel device that was connected to a handset was described as an example in this embodiment, but the present invention is not limited to this.

For example, the cord reel device can be one in which a headphone cord, an electrical wiring cord, an optical cord, or any of various other types of cord is wound and housed.

B

In the above embodiment, an example was given in which the convex portion 57 provided in the second case 56 was formed so as to protrude toward the rotational axis 48 of the first and second reel bodies 42 and 46, but the present invention is not limited to this.

For example, the convex portion may protrude toward the winding space in a second case, and may be disposed at a position that effectively keeps the turnaround portion of the internal cord from being wound in when the pullout cord is wound.

INDUSTRIAL APPLICABILITY

The present invention is useful as a reliable cord reel device with which winding problems can be effectively suppressed.

The invention claimed is:

1. A cord reel device, comprising:

a first reel body and a second reel body that are linked in the rotational axis direction so that their rotational axes coincide;

a reel case that houses the first reel body and the second reel body in a rotatable state;

a pullout cord that is wound around the first reel body so that it can be pulled out, and that is pulled outside of the reel case;

an internal cord that is wound around the second reel body in the same direction as the winding direction of the pullout cord, and that has free play in a space formed inside the reel case as the pullout cord is pulled out; and a convex portion that is provided to the reel case and protrudes from an inner peripheral side of the case and towards the rotational axis of the first and second reel bodies; and wherein the convex portion forms a pocket space for latching a slack portion of the internal cord.

2. The cord reel device according to claim 1, wherein the convex portion protrudes toward the rotational axis in the space in which the internal cord is wound.

3. The cord reel device according to claim 1, wherein the convex portion is provided in the space formed inside the reel case and in which the internal cord is wound, upstream from the position where a second end is fixed on an opposite side from a first end connected to the rotational axis of the internal cord, in the winding direction of the internal cord when the pulled-out pullout cord is wound.

4. The cord reel device according to claim 1, wherein the convex portion is formed integrally with the reel case.

5. The cord reel device according to claim 1, further comprising side wall portions that are provided to a pullout cord winding shaft of the second reel body, and are provided so as to incline at a specific angle with respect to the winding direction of the pullout cord.

6. The cord reel device according to claim 5, wherein the specific angle is at least 3 degrees and no more than 10 degrees.

7. The cord reel device according to claim 1, wherein the convex portion has a substantially arc-shaped cord latching wall as a part of a wall face forming the protruding portion.

8. The cord reel device according to claim 7, wherein, in the winding of the pulled-out pullout cord, the cord latching wall is disposed on an upstream face in the winding direction of the internal cord.

* * * * *